US007114803B2

(12) United States Patent
Rousseau

(10) Patent No.: US 7,114,803 B2
(45) Date of Patent: Oct. 3, 2006

(54) LATCHING MECHANISM FOR DRUM MAINTENANCE UNIT

(75) Inventor: Gerard H. Rousseau, Portland, OR (US)

(73) Assignee: Xerox Corporation, Stamford, CT (US)

( * ) Notice: Subject to any disclaimer, the term of this patent is extended or adjusted under 35 U.S.C. 154(b) by 276 days.

(21) Appl. No.: 10/707,577

(22) Filed: Dec. 22, 2003

(65) Prior Publication Data

US 2005/0134666 A1 Jun. 23, 2005

(51) Int. Cl.
*B41J 2/01* (2006.01)

(52) U.S. Cl. ..... 347/103; 347/101

(58) Field of Classification Search ..... 347/103
See application file for complete search history.

(56) References Cited

U.S. PATENT DOCUMENTS 5,372,852 A 12/1994 Titterington et al.
5,805,191 A 9/1998 Jones et al.
5,808,645 A 9/1998 Reeves et al.
6,068,372 A 5/2000 Rousseau et al.
6,176,575 B1 1/2001 Crawford et al.
6,428,225 B1 * 8/2002 Nguyen et al. ..... 400/613

* cited by examiner

*Primary Examiner*—Manish S. Shah
*Assistant Examiner*—Ly T. Tran
(74) *Attorney, Agent, or Firm*—Oliff & Berridge, PLC

(57) ABSTRACT

A latching mechanism is provided on a Drum Maintenance Unit (drum maintenance unit). The latching mechanism releasably secures the drum maintenance unit to a media device when installed in the media device and provides an electrical connection. The latching mechanism contacts with a locking tab and a data connection that may be located on a receiving portion of the media device. This arrangement allows the latching mechanism to simultaneously latch and connect with a receiving portion of the media device. The latching device of the connection device may be provided to releasably lock with the media device until a predetermined amount of force is applied.

11 Claims, 8 Drawing Sheets

LATCHING MECHANISM FOR DRUM MAINTENANCE UNIT

BACKGROUND OF THE INVENTION

1. Field of Invention

The present invention relates to printing, a latching mechanism for installing a Drum Maintenance Unit in a media device.

2. Description of Related Art

Ink jet printing systems have utilized intermediate transfer surfaces, such as that disclosed in U.S. Pat. No. 4,538,156 to Durkee et al. This patent discloses a system wherein an intermediate transfer drum is employed with a print head. The surface of the transfer drum may be of a plastic material, such as teflon, tefzel, mylar or the like. In addition, smooth metal or ceramic surfaces can be used. A final receiving surface of paper is brought into contact with the intermediate transfer drum after the image has been placed thereon by the nozzles in the print head. The image is then transferred to the final receiving surface. A cleaning medium is then brought into contact with the intermediate transfer drum to prepare the surface of the drum prior to the next image being formed on the transfer surface.

Ink jet printing systems that utilize a liquid intermediate transfer surface generally require an applicator that is housed in a replaceable transfer drum maintenance cassette. An exemplary applicator of this type is disclosed in U.S. Pat. No. 5,808,645 to Reeves et al. Upon insertion of the cassette into a printer, a support mechanism in the printer located below the cassette may sense the presence of the cassette. In addition, the life of the cassette is determined by two opposing sensors placed on opposite side of the cassette to determine the remaining life of the spool of wick as it is incrementally unwound. When either of the opposing sensors is permitted to see an opposing non-reflective surface the sensing is broken and a signal is sent to the printer that the cassette is nearing time for replacement.

U.S. Pat. No. 6,068,372 to Rousseau et al. (hereinafter "the 372 patent") discloses a replaceable liquid application system for applying a liquid intermediate transfer surface to a support surface in a printer. The liquid application system is contained in a removable cassette and utilizes a liquid impregnated arcuate surface that engages the support surface by rolling contact. The liquid impregnated arcuate surface is contained in a removable cartridge that is housed within the cassette. A cartridge life status assembly is provided on the removable cassette to determine when the useful life of the cartridge has been exhausted. Push tabs on the cartridge and finger wells on the cassette allow for easy and convenient removal of a used cartridge and insertion of a replacement cartridge within the cassette.

SUMMARY OF THE INVENTION

To install the Drum Maintenance Unit (DMU) in current solid ink printers, the drum maintenance unit has a latching mechanism and a sensing mechanism that are separate from one another. With this arrangement it is possible to provide a false signal to a media device, such as a printer. For example, a printer could receive a signal that the drum maintenance unit has been installed when the drum maintenance unit has not been properly installed or no signal at all when the drum maintenance unit is properly installed. Either scenario may potentially harm the printer and the integrity of the drum maintenance unit.

A mechanism is needed to provide both latching and sensing when a drum maintenance unit is installed in a media device.

This invention provides improved reliability characteristics for installation of a drum maintenance unit in a media device.

This invention provides simultaneous latching and electrical contact of a drum maintenance unit in a media device.

This invention separately provides a sensing mechanism that sends a signal to the media device when the drum maintenance unit is properly installed.

This invention allows the media device to operate only when latching and electrical contact are both achieved.

This invention provides a single device that functions as a latching mechanism and a positioning mechanism.

This invention separately provides proper alignment of a drum maintenance unit when installed in a media device.

This invention separately provides a ground connection, a data connection and a latching mechanism.

This invention separately provides a sensing mechanism that monitors remaining life of the drum maintenance unit.

This invention separately provides a protective layer between the sensing mechanism of the drum maintenance unit and the media device.

According to various exemplary embodiments of this invention, a drum maintenance unit includes a latching mechanism that releasably secures the drum maintenance unit to a media device. The latching mechanism also provides an electrical contact with the media device when the drum maintenance unit is installed in the media device.

In various exemplary embodiments, the latching mechanism provides a signal to a media device when the drum maintenance unit is properly installed in the media device.

In various exemplary embodiments, a sensing mechanism is provided that is electrically connected to the latching mechanism.

In various exemplary embodiments, the sensing mechanism is a data device that is in communication with the media device.

In various exemplary embodiments, the latching mechanism provides a data connection point between the data device and the media device when the drum maintenance unit is installed in the media device.

In various exemplary embodiments, a protective layer is provided between the between the data connection point of the data device and the media device when the drum maintenance unit is installed in the media device. In other various exemplary embodiments, the protective layer is a metal mesh. In still other various exemplary embodiments, the protective layer has properties to prevent corrosion between the data device and the media device when the drum maintenance unit is installed in the media device.

In various exemplary embodiments, the electrical contact of the latching mechanism is an electrical ground.

In various exemplary embodiments, a recess is formed on a portion of either the drum maintenance unit or the media device. A corresponding member is provided on the other of the drum maintenance unit or the media device to engage the recess when the drum maintenance unit is installed in a media device. In other exemplary embodiments, the recess is an angular slot. In still other exemplary embodiments the angular slot is a V shaped slot.

In various exemplary embodiments, the V shaped slot has a first surface so as to bias the corresponding member. In other exemplary embodiments, the first surface has a dimple to facilitate contact with the corresponding member. In still other various exemplary embodiments, the V shaped slot has a second surface with a second dimple to contact the corresponding member.

In various exemplary embodiments, the drum maintenance unit includes a positioning mechanism that properly positions the drum maintenance unit to a media device. The positioning mechanism also provides electrical contact with the media device when the drum maintenance unit is installed in the media device. In other exemplary embodiments, the positioning mechanism has a data device that provides a signal to the media device when the drum maintenance unit is installed in the media device.

In various exemplary embodiments, the method of installing the drum maintenance unit according to this invention includes the steps of: releasably securing the drum maintenance unit to the media device in a desired position; and simultaneously providing an electrical connection between the drum maintenance unit and the media device. In other exemplary embodiments, releasably securing the drum maintenance unit in a desired position by aligning a roller of the drum maintenance unit with a corresponding portion of the media device. In still other exemplary embodiments, the electrical connection is a data connection between the media device and the drum maintenance unit when the drum maintenance unit is installed in the media device.

These and other features and advantages of this invention are described in, or are apparent from, the following detailed description of various exemplary embodiments of the drum maintenance unit according to this invention.

BRIEF DESCRIPTION OF THE DRAWINGS

Various exemplary embodiments of the drum maintenance unit of this invention are described in detail below, with reference to the attached drawing figures, in which.

DETAILED DESCRIPTION OF EXEMPLARY EMBODIMENTS

Figure 1:
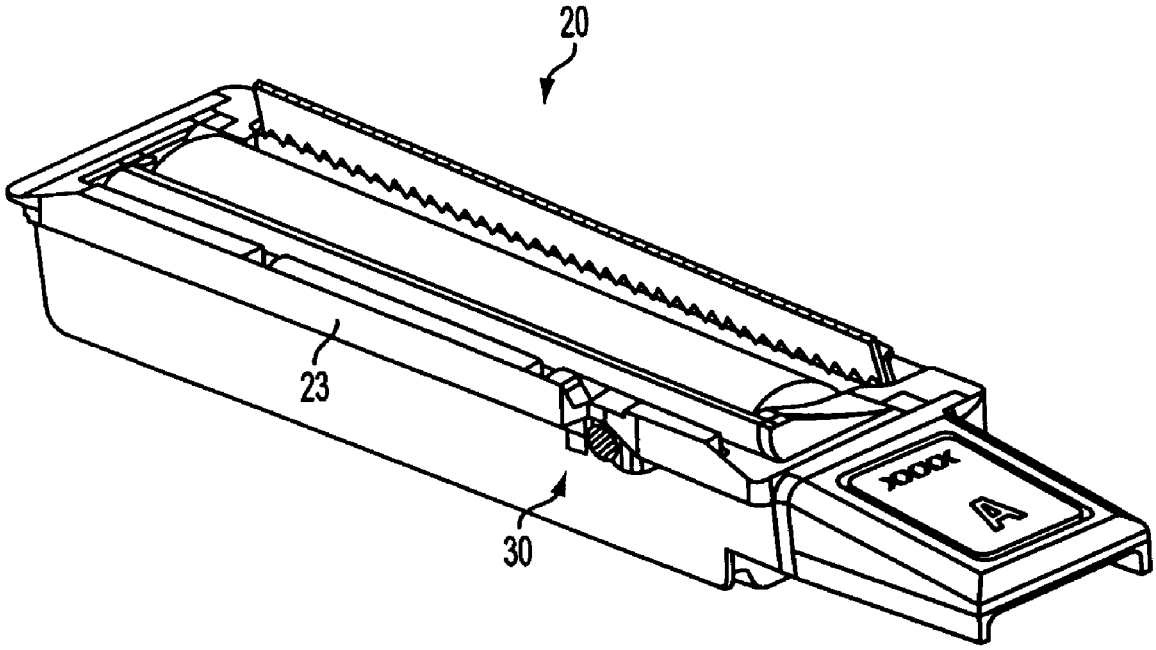
FIG. 1 is a perspective view of an exemplary embodiment of a Drum Maintenance Unit according to this invention.

In various exemplary embodiments of this invention a Drum Maintenance Unit according includes a latching mechanism that simultaneously releasably secures the drum maintenance unit in a media device and connects a sensing mechanism to the media device when the drum maintenance unit is installed in the media device. The latching mechanism is housed on an exterior side ledge or guide of the drum maintenance unit to facilitate the connection. As the drum maintenance unit is inserted into the media device, the guide is slid within a receiving portion of a pivot arm of the media device.

According to various embodiments of this invention, the receiving portion of the pivot arm has a locking tab and a sensing device that engage with the latching mechanism only when the drum maintenance unit is properly or completely installed. When properly installed, the latching mechanism simultaneously secures the drum maintenance unit and provides a signal to the media device that a drum maintenance unit is detected and operation is allowed.

According to other various embodiments of this invention, the latching mechanism has a housing that provides a locking device and simultaneously a ground connection with the media device. The latching mechanism also retains the sensing mechanism. The locking device has a V shaped slot to receive the locking tab of the pivot arm.

According to still other various embodiments of this invention, the V slot has a first surface or first half of the V slot that engages and locks with the locking tab. A dimple is further provided on the first surface to facilitate contact with the locking tab. Thus, the V slot simultaneously locks and couples a ground connection with the media device. The first surface is angled to have a steep slope to releasably lock the drum maintenance unit in the media device and release when a predetermined amount of force is applied to remove the drum maintenance unit.

In one exemplary embodiment, a second half or a second surface of the V slot is designed as a safety feature that takes into account various tolerances that occur for each of the elements during the manufacturing process. The second surface also has a dimple to facilitate a connection with the locking tab. For example, if the locking tab does not bias the first surface of the V slot then, at the very least, the locking tab will contact the second surface to provide a signal to the media device. Then when the drum maintenance unit is removed the first surface contacts the locking tab and bias one another until a predetermined amount of force is applied to deflect the locking tab and remove the drum maintenance unit from the media device.

The sensing mechanism may be a memory or data device which can be a single wire, read/write data carrier that connects with a data connection of the media device. For example, the data device may be an EEPROM device which stores the number of print jobs performed and monitors the remaining life of the drum maintenance unit. This information is retained even when the drum maintenance unit is swapped out and placed in another media device. A metal fabric or material may be further provided and placed between the EEPROM device and the data connection of the receiving portion of the media device. The metal fabric diminishes corrosion between the surfaces of the EEPROM device and the data connection to prevent loss of electrical contact.

FIG. 1 shows an exemplary embodiment of a drum maintenance unit 20. According to this configuration, the drum maintenance unit 20 comprises a latching mechanism 30 that may be located on an exterior guide rail 23 of the drum maintenance unit 20 to facilitate contact when inserted into a media device (not shown).

Figure 2:
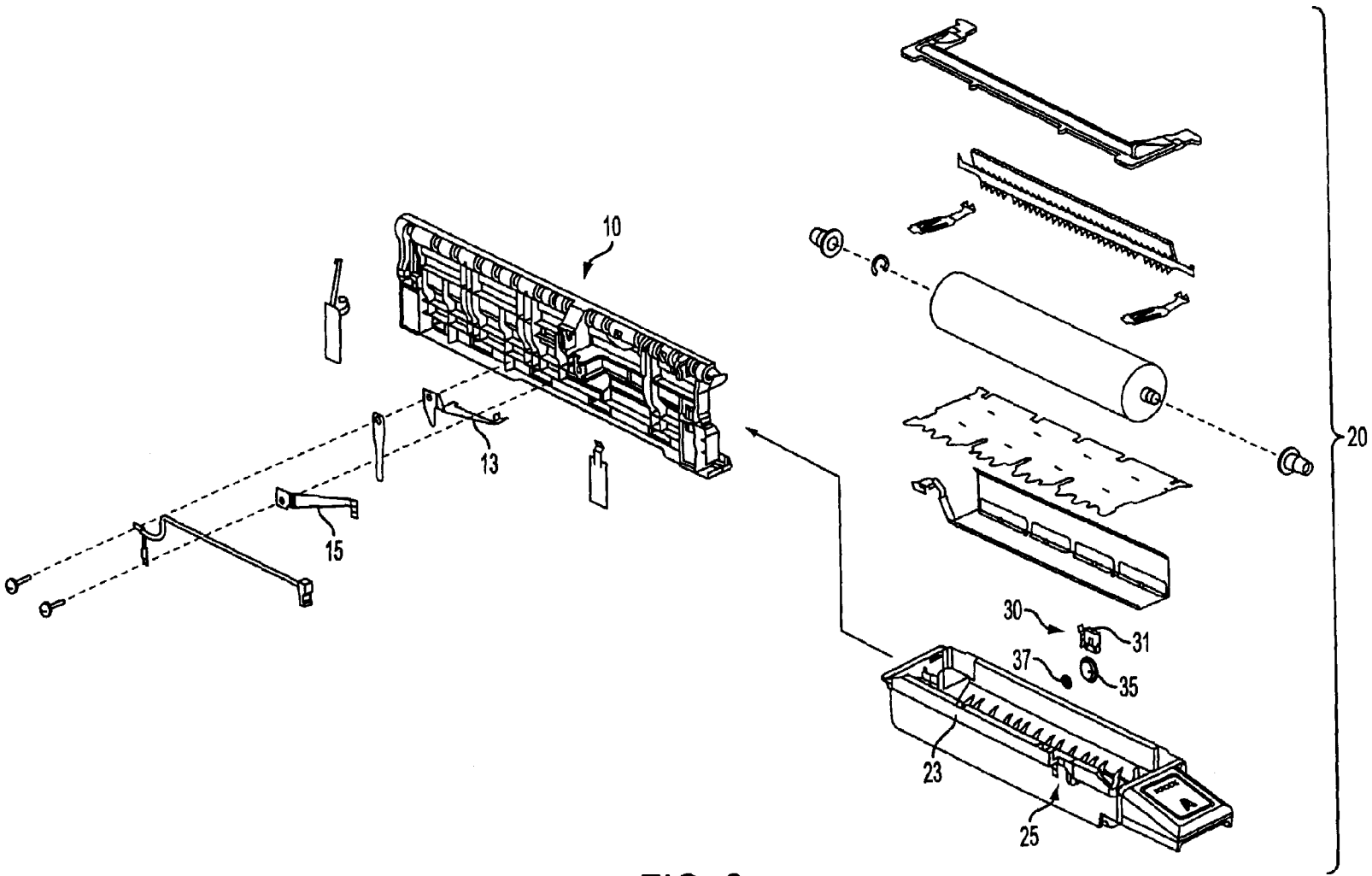
FIG. 2 is a perspective view showing an exploded view of the exemplary drum maintenance unit prior to installation with a receiving portion of a media device.

FIG. 2 shows an exemplary embodiment of the drum maintenance unit 20 in an exploded perspective view. The components of the drum maintenance unit such as the metering blade assembly, the oiling roller, the filter and the shield are described in copending U.S. application Ser. Nos. (117420, 117421, 117422 and 117424).

The latching mechanism 30 is shown in an exploded view showing various components. The media device has a receiving portion 10 shown with locking tab 13 and data connection 15 disassembled. Drum maintenance unit 20 is installed in the media device as indicated by the arrow so that guide rail 23 slidably fits within receiving portion 10 of the media device. Ledge 23 has a connection housing 25 for accommodating the latching mechanism 30.

Figure 3:
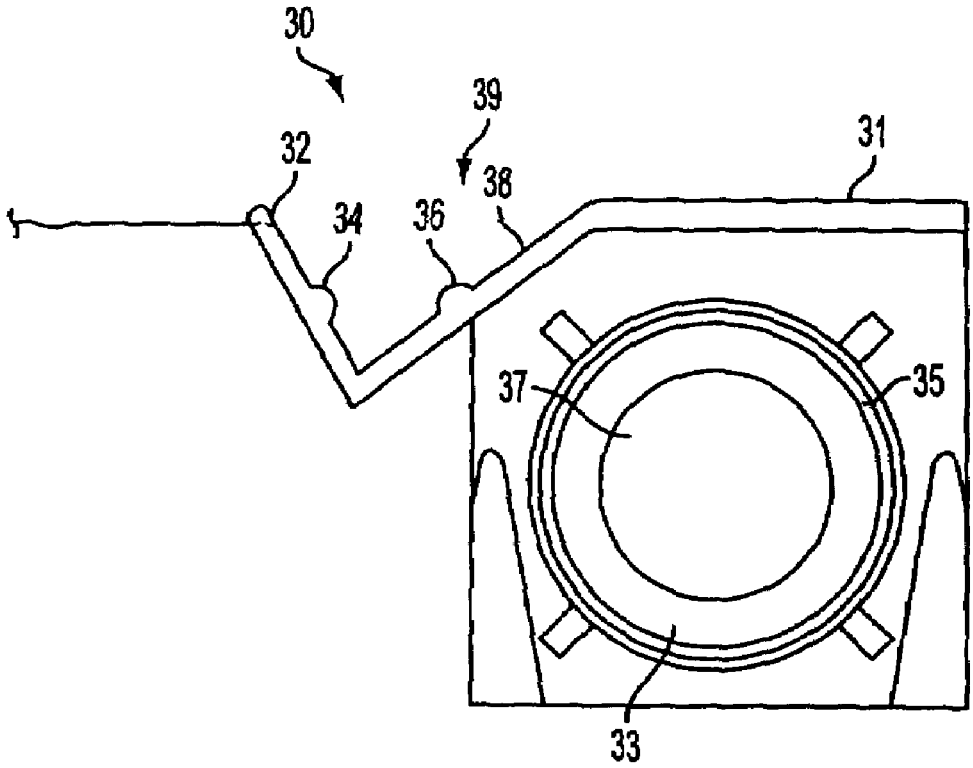
FIG. 3 is an enlarged view of an exemplary latching mechanism according to this invention.
Figure 5:
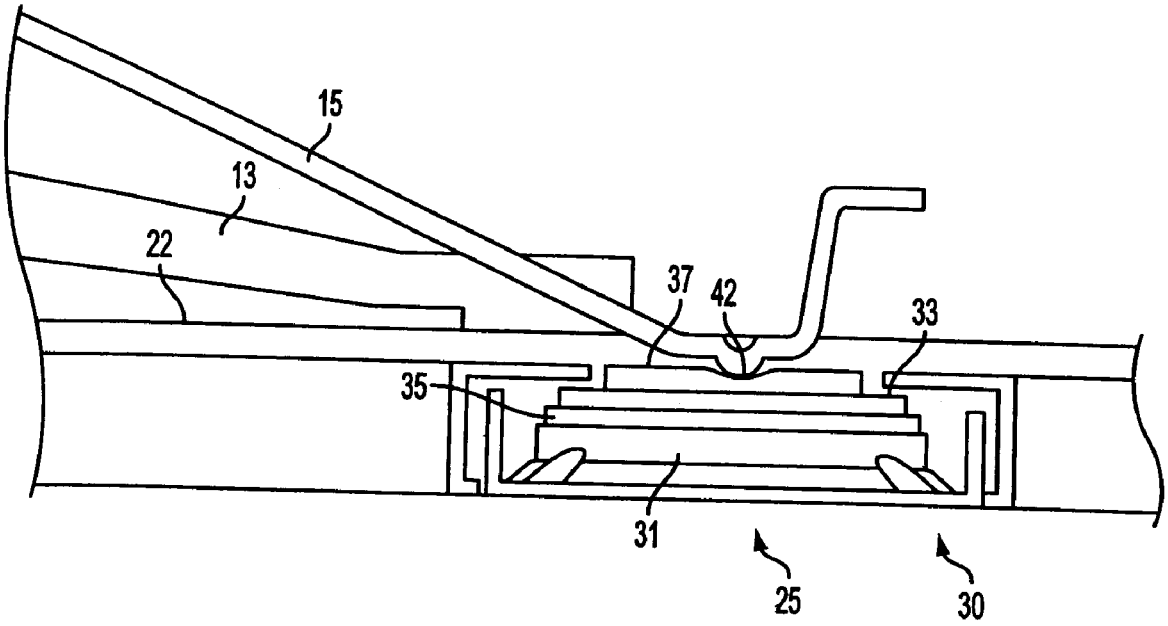
FIG. 5 is a partial top view of the exemplary latching mechanism in contact with the sensing device of the media device.

FIG. 3 shows an exemplary embodiment of the latching mechanism 30. According to this configuration, the latching mechanism 30 has a main housing 31 that accommodates an EEPROM device 35. The EEPROM device 35 has a ground connection with housing 31 and a data surface 33 that contacts with data connection 15 when the drum maintenance unit 20 is installed in a media device (as shown in FIG. 5). The EEPROM device 33 may store the number of print jobs completed and determine the remaining life of drum maintenance unit 20. By keeping track of the usage level of drum maintenance unit 20, a signal may be provided to the media device so that a user may be informed of when to replace drum maintenance unit 20. Also, in the event drum maintenance unit 20 is swapped out and placed in another media device, EEPROM 35 still retains the remaining life information of drum maintenance unit 20.

Figure 4:
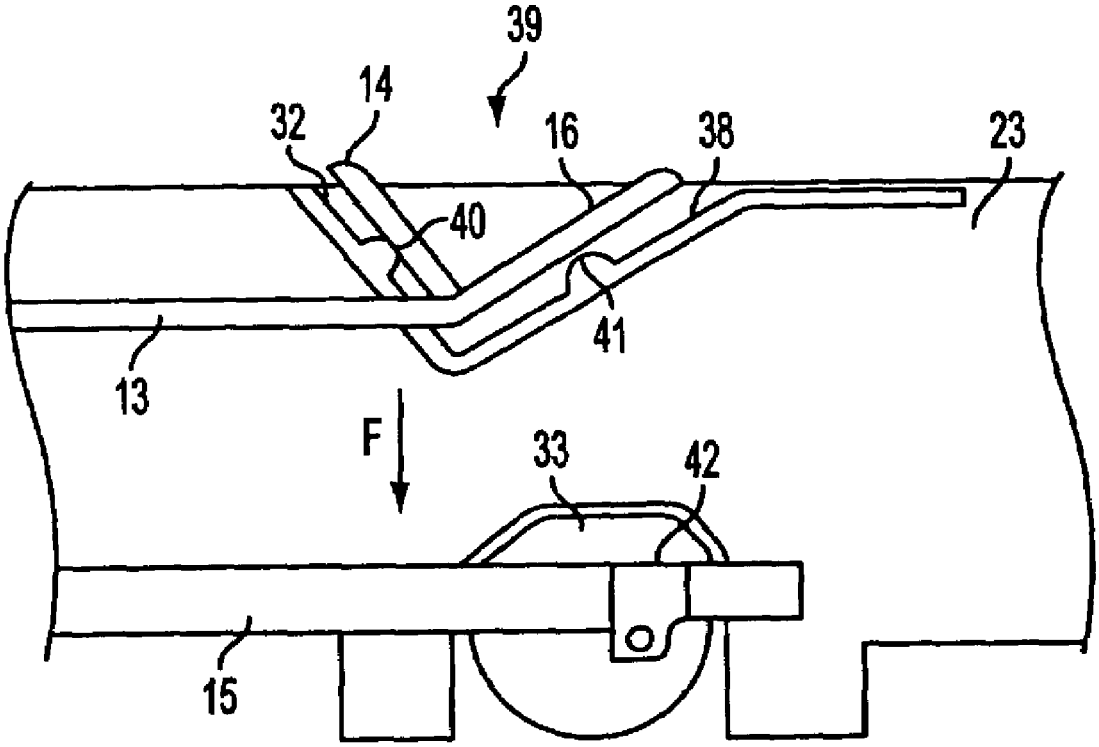
FIG. 4 is a partial side view of the exemplary latching mechanism in contact with connectors of the pivot arm of the media device.

As shown in FIG. 4, the housing 31 may be accommodated on the ledge 23. The ledge 23 may provide a V shaped indentation (as shown in FIG. 2) that can accommodate a V slot 39 of the housing 31, as shown in FIG. 3. The V slot 39 may act both a locking device and an electrical connection. The V slot 39 may be placed on an exterior surface of the housing 31 to facilitate the connection with the media device. A first half or locking surface 32 of the V slot 39 can be oriented to bias with a locking tab 13 of the receiving portion 10, as shown in FIG. 4. In this manner, the locking surface 32 engages with the tab 13 to releasably secure drum maintenance unit 20 within the media device and simultaneously provide an electrical connection therebetween. In addition, a dimple 34 may be provided on the surface 32 to further assure contact with the tab 13.

As shown in FIG. 4, the locking surface 32 may be angled with a relatively steep slope to releasably engage with the tab 13. The angle of the surface 32 is oriented to provide a predetermined amount of force F when the surface 32 biases with the tab 13. At the very least, contact may be achieved at a locking point 40 and the bias between a locking end 14 and the surface 32 is latched due to force F. The locking end 14 of the tab 13 may be made to release or unlock from the locking surface 32 when a predetermined amount of force is applied. When the predetermined amount of force is applied, or force F is overcome, the tab 13 deflects and drum maintenance unit 20 may be removed from the media device.

The V slot 39 may further be provided with a second half or second surface 38. The surface 38 may act as a safety feature to assure electrical connection with the tab 13 of the receiving portion 10. In the manufacturing process, component parts are manufactured ideally within a tolerance range. However, as the manufacturing process is sometimes not precise, the tolerance range may deviate and component parts may be manufactured outside the desired range. The second surface 38 may be positioned so that if the tab 13 does not contact the locking surface 32, contact may be made with the surface 38. Also, the surface 38 can further be provided with a dimple 36 to assure connection with the receiving portion 10. FIG. 4 shows an example of one possible scenario where the safety tab 16 does not contact the second surface 38. However, it is also possible that both of the surfaces 32 and 38 contact the tabs 14 and 16, respectively.

The physical contact between the data connection 15 and the EEPROM device 35 may bring another set of problems. In operation, drum maintenance unit 20 is repeatedly actuated within the media device over its lifetime between at least two positions, an activated position that brings drum maintenance unit 20 in a contact position with the imaging drum of the media device and a deactivated position where the drum maintenance unit 20 is in a non-contact or rest position with the imaging drum (not shown). This repeated movement may put different parts under mechanical stress, such as the data connection 15 and the EEPROM device 35.

As the data connection 15 biases against the data surface 33 friction as shown by arrow ff may develop between the two due to the load applied and the movement of drum maintenance unit 20. When at least one of the data connection 15 and the data surface 33 is steel, the friction allows the steel to oxidize and rust develops. If the rust is allowed to continue develop, a layer of rust is formed between the data connection point 42 and the EEPROM device 35. As rust is electrically insulating, loss of electrical contact may occur and the media device will interpret the loss of signal to mean that no drum maintenance unit 20 is installed.

Figure 6:
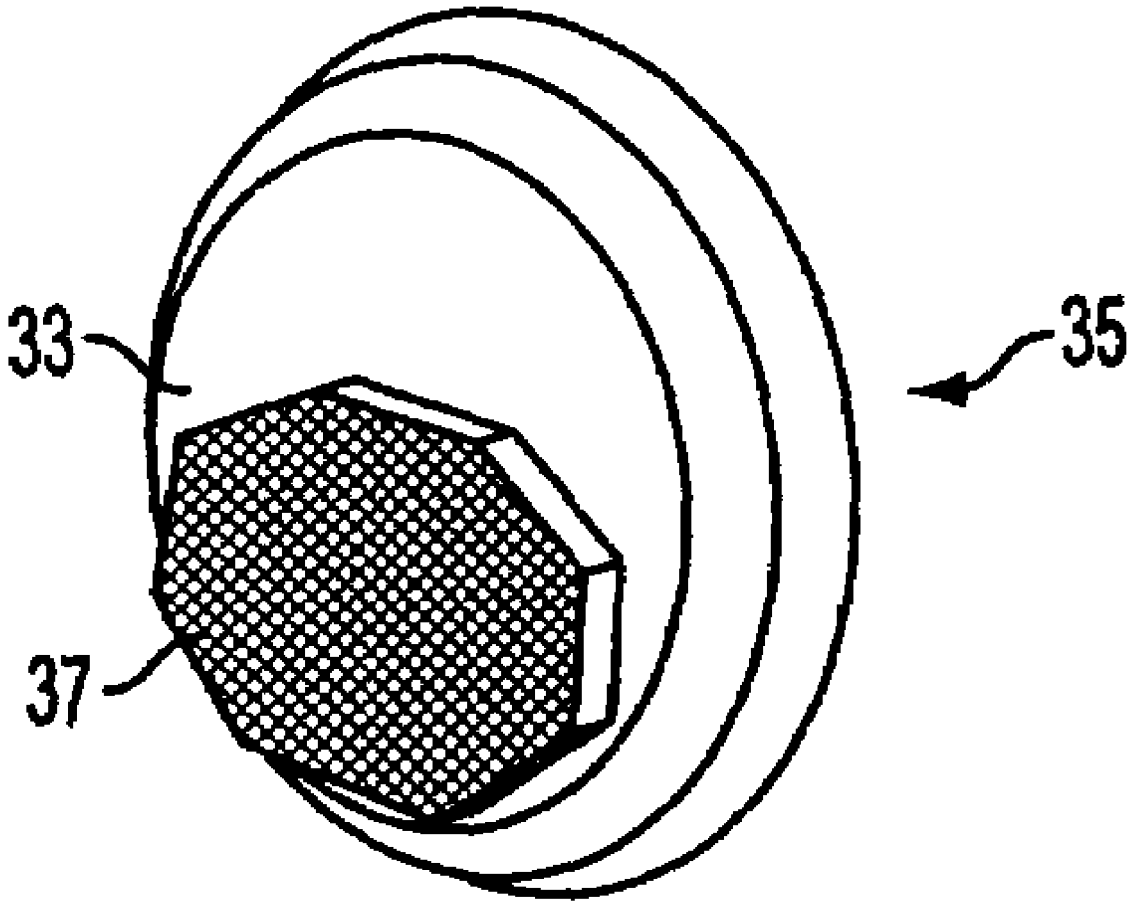
FIG. 6 is a perspective view of an exemplary embodiment of a sensing mechanism and a protective layer according to this invention.
Figure 7:
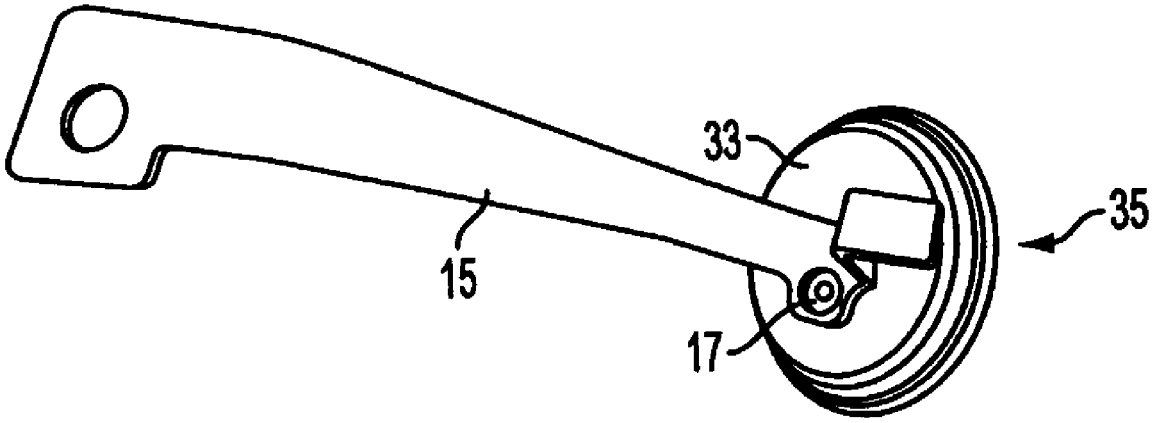
FIG. 7 is a perspective view of an exemplary embodiment of a data connection between a media device and a sensing mechanism according to the invention (with protective layer not shown)
Figure 8:
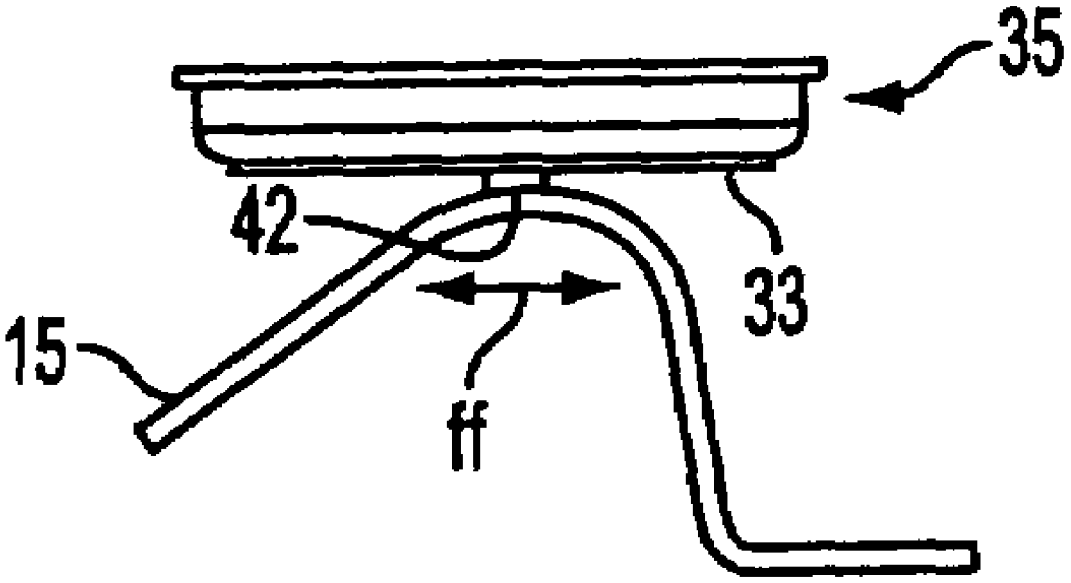
FIG. 8 is a top view of the exemplary data connection of FIG. 7.

To overcome this problem, in various exemplary embodiments, a protective layer 37 may be provided, as shown in FIGS. 3, 5 and 6. The protective layer 37 may be an electrically conductive fabric, foam, coating or other material such as that sold by Laird Technologies. The protective layer 37 provides a physical barrier between the data connection 15 and the data surface 33 to diminish the development of corrosion or rust. Also, the protective layer 37 reduces the contact pressure between the data connection 15 and the data surface 33 by distributing the load across a larger surface area. In addition, the protective layer 37 not only reduces the friction between the data surface 33 and the data connection 15, but it also may absorb the relative motion when drum maintenance unit is actuated so as to retain electrical contact. The protective layer 37 may be any layer or barrier that diminishes corrosion.

FIG. 5 shows an exemplary embodiment of the latching mechanism 30 housed within the connection housing 25. The housing 25 sits within the ledge 23 to simultaneously latch drum maintenance unit 20 with the receiving portion 10 of the media device (not shown), create a ground connection, and couple the EEPROM device 35 with the data connection 15 to communicate with the media device. In this embodiment, the protective layer 37 is shown as a metal fabric that distributes the load applied by the data connection 15.

While this invention has been described in conjunction with various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

For example, the latching mechanism may be any suitable structure, either known or hereafter developed, that is capable of implementation in a drum maintenance unit and/or a media device. Thus, while a locking surface is shown in the various exemplary embodiments, other suitable structures, such as a lock pawl configuration or any other deflectable latch, are contemplated. Further, the particular configuration of the latching mechanism is not limited to the various exemplary embodiments described above. On the contrary, various configurations, either known or hereafter developed, for a latching mechanism that latches and simultaneously provides an electrical connection are contemplated. For example, the latching slot may be provided on the receiving portion and the latching tab provided on the drum maintenance unit. In addition, if a latching slot is used it may be any shape so as to releasably lock.

What is claimed is:

1. A drum maintenance unit comprising:

a latching mechanism that releasably secures the drum maintenance unit to a media device and provides electrical contact with the media device when the drum maintenance unit is installed in the media device;

a sensing mechanism comprising a data device in electrical contact with the latching mechanism, wherein the latching mechanism further provides a data connection point between the data device and the media device when the drum maintenance unit is installed in the media device; and a protective layer provided between the data connection point of the data device and the media device when the drum maintenance unit is installed in the media device.

2. The drum maintenance unit according to claim 1, wherein the latching mechanism provides a signal to the media device that the drum maintenance unit is properly installed in the media device.

3. The drum maintenance unit according to claim 1, wherein the protective layer comprises a metal mesh.

4. The drum maintenance unit according to claim 1, wherein the protective layer has properties to prevent corrosion between the data device and the media device.

5. The drum maintenance unit according to claim 1, wherein the latching mechanism provides an electrical ground for the drum maintenance unit when the drum maintenance unit is installed in a media device.

6. The drum maintenance unit according to claim 1, further comprising a recess formed in a portion of one of the drum maintenance unit and a media device and a corresponding member on the other of the drum maintenance unit and the media device, the corresponding member being adapted to engage the recess when the drum maintenance unit is installed in a media device.

7. The drum maintenance unit according to claim 6, wherein the recess comprises an angular slot.

8. The drum maintenance unit according to claim 7, wherein the angular slot comprises a V shaped slot.

9. A drum maintenance unit comprising:

a positioning mechanism that properly positions the drum maintenance unit to a media device and provides electrical contact with the media device when the drum maintenance unit is installed in the media device, wherein the positioning mechanism provides a signal to the media device when the drum maintenance unit is properly installed in the media device;

a latching mechanism that releasably secures the drum maintenance unit to a media device and provides electrical contact with the media device when the drum maintenance unit is installed in the media device;

a sensing mechanism comprising a data device in electrical contact with the latching mechanism, wherein the latching mechanism further provides a data connection point between the data device and the media device when the drum maintenance unit is installed in the media device; and a protective layer provided between the data connection point of the data device and the media device when the drum maintenance unit is installed in the media device.

10. A drum maintenance unit comprising:

a latching mechanism that releasably secures the drum maintenance unit to a media device and provides electrical contact with the media device when the drum maintenance unit is installed in the media device and a recess formed in a portion of one of the drum maintenance unit and a media device and a corresponding member on the other of the drum maintenance unit and the media device, the corresponding member being adapted to engage the recess when the drum maintenance unit is installed in a media device, wherein the recess further comprises an angular slot comprising a V shaped slot with a first surface that has a first dimple, and the first surface is oriented so that at least the first dimple is in contact with the corresponding member of the device.

11. The drum maintenance unit according to claim 10, wherein the V shaped slot has a second surface that has a second dimple to assure that contact is made with the corresponding member of the device.

* * * * *